United States Patent [19]

Kondis

[11] 3,986,674

[45] *Oct. 19, 1976

[54] MONITORING ACTIVATION OF PARTICULATE ALUMINUM

[75] Inventor: Thomas J. Kondis, Pittsburgh, Pa.

[73] Assignee: Aluminum Company of America, Pittsburgh, Pa.

[ * ] Notice: The portion of the term of this patent subsequent to June 17, 1992, has been disclaimed.

[22] Filed: May 5, 1975

[21] Appl. No.: 574,369

Related U.S. Application Data

[63] Continuation-in-part of Ser. No. 307,334, Nov. 17, 1972, Pat. No. 3,890,166.

[52] U.S. Cl. ..... 241/15; 148/6.27

[51] Int. Cl.[2] ..... C23F 7/00

[58] Field of Search ..... 241/15, 16, 20, 21

[56] References Cited

UNITED STATES PATENTS

| | | | |
|---|---|---|---|
| 3,301,494 | 1/1967 | Tornquist | 241/16 X |
| 3,476,325 | 11/1969 | Groszek | 241/16 |
| 3,551,174 | 12/1970 | Hauska et al. | 241/16 X |
| 3,890,166 | 6/1975 | Kondis | 241/15 X |

*Primary Examiner*—Granville Y. Custer, Jr.
*Attorney, Agent, or Firm*—John P. Taylor

[57] ABSTRACT

Monitoring the production of a reactive or pyrophoric aluminum (produced by the milling of particulate aluminum in the presence of a subsequently displaceable material capable of sorbing onto the surface of the aluminum sufficiently to stabilize it) to ensure that the mill does not revert to conditions wherein welding rather than comminution predominates.

7 Claims, No Drawings

MONITORING ACTIVATION OF PARTICULATE ALUMINUM

CROSS-REFERENCE TO RELATED APPLICATIONS

This aplication is a continuation-in-part of application Ser. No. 307,334, filed Nov. 17, 1972 and issued on June 17, 1975 as U.S. Pat. No. 3,890,166.

BACKGROUND OF THE INVENTION

1. Field of the Invention

This invention relates to activation of aluminum particles. More particularly, it relates to monitoring the production of an active particulate aluminum by improved milling. By aluminum, I mean aluminum and aluminum base alloys containing at least 50% by weight aluminum.

2. Description of the Prior Art

Particulate aluminum or aluminum powder, for example, atomized powder, is sometimes milled in an inert atmosphere in the presence of inert hydrocarbons such as hexane, kerosene, benzene, mineral spirits and the like, to avoid excessive formation of an oxide-coated surface and to produce aluminum which will combine under pressure with hydrogen gas and an olefin such as ethylene or isobutylene to form an alkylaluminum compound. Aluminum milled in this way, however, does not always exhibit the required degree of activity, perhaps because of the formation of conglomerates of small particles welded and pounded together in a manner which prevents formation of the desired amount of fines of small particle size and of sufficient surface area and low oxide content. Therefore, finding a method of ensuring production of an active or pyrophoric aluminum consistently sufficiently reactive to form further useful products such as, for example, alkylaluminum compounds, represents a highly desirable result.

In my parent U.S. Pat. No. 3,890,166, previously referred to above, I disclose and claim milling particulate aluminum in the presence of a material (which I called a milling aid) that will sorb onto the surface of the aluminum sufficiently to stabilize it against rewelding but insufficietly to prevent access to the nascent aluminum surface by a reactive substance, and which thereby imparts to aluminum a high degree of activity, particularly, chemical reactivity. Highly sorptive oxygen-containing compounds of limited reactivity were found to be most efficient in preparing active aluminum according to that invention. By "highly sorptive", I mean having the capability of being easily or readily sorbed onto the surface of the aluminum particles. By "of limited reactivity", I mean of insufficient reactivity to react to produce an undesirable new compound in bulk during the milling. The milling aid disclosed and claimed therein must be so constructed or made up that it sorbs onto the surface of the particulate aluminum during milling just enough to protect it adequately in the mill, that is, just enough to promote comminution rather than welding of particles, but can be displaced by another material or otherwise allow access to the nascent aluminum after completion of the milling. It should leave sites of nascent aluminum intermingled with sorbed sites.

It was further pointed out that milling time is significant only insofar as milling does not continue beyond the time required to generate enough new surface to sorb the milling aid available in the mill, as total utilization of the milling aid causes an active milling environment to revert to an inactive environment, and welding rather than comminution begins to predominate.

SUMMARY OF THE INVENTION

I have now discovered that the milling operation advantageously can be monitored to determine whether such an active milling environment exists in the mill thus ensuring a higher yield of activated aluminum using the process claimed in my parent Pat. U.S. No. 3,890,166.

DESCRIPTION OF THE INVENTION

The particulate aluminum that may be activated in the presence of milling aids such as identified hereinabove includes atomized aluminum, granulated aluminum, powdered aluminum, aluminum powder, or any other type of aluminum particles fine enough to be milled, for example, in a rotating ball mill or vibratory mill. The particle size is not critical according to the invention. Preferred milling is in the presence of an inert hydrocarbon such as benzene or kerosene in addition to the required milling aid.

Preferred compounds coming within the category of milling aids include ketones, aldehydes, amides, carboxylic acids, peroxides, epoxies, ethers, (such as isopropyl ether), esters, organic phosphates, organic nitrates, organic sulfonates, silicones and anhydrides. Olefins, hydrocarbon free radicals, hydrazine free radicals and chlorinated hydrocarbons (including carbon tetrachloride) are also representative of materials which have the required sorptive power, that is, power to be sorbed on the surface of the aluminum, for producing the desired activity in aluminum milled according to the invention.

According to the invention it appears that a mechanism of surface stabilization of the aluminum operates through attack of the surface by the oxygen portions of the organic molecules when oxygen-containing materials are used as the milling aids. While I do not wish to be bound by any particular theory of how this attack may occur, in the case of methyl ethyl ketone, for example, a preferred milling aid according to the invention, the reaction may be postulated as follows, illustrating the carbonyl pi bond as a pair of dots:

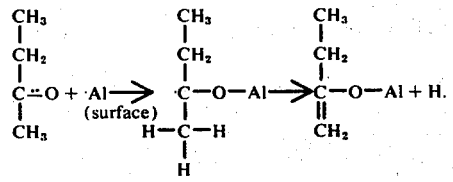

Prior to my invention, that is, in the absence of the milling aids defined hereinabove, the fresh surfaces generated on the aluminum during milling were unstable under inert milling conditions. Thus, the particles were readily combined and/or welded together, particularly when ball milled. Nor did the common practice of recycling a portion of the product alkylaluminum compound back to the mill prevent the aluminum particles from re-combining and welding, as trialkylaluminum compounds are not adequately sorbed to the surface sufficiently to promote comminution. According to my invention, on the contrary, milling aids such as those identified and listed hereinabove, effectively stabilize the surfaces freshly generated during ball milling by reacting almost immediately with the virgin aluminum or by sorbing on its surfaces, thereby precluding it from physically contacting other virgin alu surfaces.

However, as previously stated, should the milling aid be totally utilized prior to cessation of the milling, welding of particles will commence since there will be no further milling aid to stabilize the fresh surfaces which continue to be generated.

In accordance with the invention, however, this condition can be prevented or at least mitigated by monitoring the milling process to determine the point at which the milling environment changes to that in which welding will be favored over comminution.

Such monitoring can be effectively carried out by periodically measuring the bulk density of the particulate aluminum. As comminution proceeds the bulk density decreases. However, when the environment changes to begin to promote welding, the bulk density will begin to increase.

The monitoring can also be carried out by periodic measurement of the pyrophoricity or reactivity of the particulate aluminum. As comminution proceeds, reactivity increases due to an increase in the total surface area. However, when welding commences, the reactivity decreases, due to the decrease in surface area. Such measurements may be made, for example, using water as a reactant as described in Example 1 of U.S. Pat. No. 3,890,166, or using dry oxygen as in Example 2 of U.S. Pat. No. 3,890,166.

Alternatively, the surface area can be directly measured using standard gas sorption techniques based on the methods of S. Brunauer, P. H. Emmett and E. Teller ("Adsorption of Gases in Multimolecular Layers," Journal of the American Chemical Society, volume 60, pages 309–319, 1938). Radioactive phosphorus may also be employed to directly estimate surface area, based on the work of J. E. Lewis and R. C. Plumb ("A Radiochemical Technique for Determining the Specific Surface Area of Aluminum Metal Surfaces," International Journal of Applied Radiation and Isotopes, volume 1, pages 33–45, 1956). Thus direct surface area measurements may be made to monitor the milling atmosphere.

Another means of monitoring the milling environment is by direct measurement of particle size distribution to follow the progress of particle comminution. Any suitable methods known to the art may be used as, for example, by sedimentation, elutriation, light-scattering, light-interruption, electrical resistance or microscope.

As another example of how the milling atmosphere could be monitored, one can directly test for the continued presence of free milling aid in the mill using qualitative or quantitative analytical techniques sensitive to the particular milling aid being used. Standard tests for determining the presence of ketones, aldehydes, the other disclosed milling aids are well known to those skilled in the art and need not be recounted here.

Still another alternative monitoring technique which might be deemed to be an auxiliary alternative would be the timing of the grinding period based on previous data collected under substantially similar conditions using any of the other monitoring techniques disclosed above. The following examples further illustrate the invention wherein the milling operation was monitored to determine when mill conditions changed from favoring comminution to favoring welding:

EXAMPLE 1

Alcoa grade No. 120 atomized aluminum was milled in hexane slurry with 0.07 mole acetaldehyde as milling aid per mole aluminum. Prior to charging hexane and acetaldehyde into the mill, the air atmosphere had been evacuated from the mill containing steel balls and atomized aluminum; the liquids were then charged without admission of air. After milling two hours, the product powder was tested for pyrophoricity with dry oxygen according to the procedure described in Example 2 of U.S. Pat. No. 3,890,166. The product powder was found to be highly pyrophoric, consuming 0.414 millimoles $O_2$ per gram aluminum. After thus forming a protective oxide film on the aluminum surface, the product powder was safely exposed to the atmosphere without difficulty, and was seen to be in a highly comminuted state. Its surface area was measured at 8 $m^2/g$, as opposed to 0.2 $m^2/g$ for the original atomized powder.

EXAMPLE 2

The procedure of Example 1 was repeated, with the exception that only 0.008 mole acetaldehyde was present per mole aluminum. After milling 2 hours, the product powder was tested for pyrophoricity as before and was found to be non-pyrophoric, consuming 0.000 millimoles $O_2$ per gram aluminum. The product powder was seen to be composed of welded particles, whose total surface area was similar to that of the original atomized powder.

What is claimed is:

1. In the process for production of a highly reactive pyrophoric aluminum which permits creation and maintenance of nascent aluminum surfaces while inhibiting rewelding together of such surfaces which comprises milling particulate aluminum in the presence of a milling aid capable of sorbing onto the surface of the aluminum sufficiently to prevent welding of the particles and at the same time allow access by a reactive substance to the nascent aluminum surface; said milling aid being selected from the group consisting of: oxygen-containing compounds, olefins, hydrocarbon free radicals, hydrazine free radicls, and chlorinated hydrocarbons, the improvement which comprises: monitoring the milling process to determine whether comminution or welding conditions exist in the mill.

2. The improvement of claim 1 wherein said particulate aluminum is removed from said mill prior to reversion of the milling environment to a condition wherein welding rather than comminution begins to predominate.

3. The improvmenet of claim 1 wherein said monitoring comprises: measurement of the bulk density of the particulate aluminum.

4. The improvement of claim 1 wherein said monitoring comprises: measurement of the pyrophoricity of the particulate aluminum.

5. The improvement of claim 1 wherein said monitoring comprises: measurement of the surface area of the particulate aluminum.

6. The improvement of claim 1 wherein said monitoring comprises: measurement of the amount of milling aid remaining in the mill.

7. The improvement of claim 1 wherein said monitoring comprises: grinding for not longer than a predetermined time period previously determined under similar conditions to provide a milling environment conducive to comminuation rather than welding.

* * * * *